US009363593B2

(12) United States Patent
Kawka et al.

(10) Patent No.: US 9,363,593 B2
(45) Date of Patent: Jun. 7, 2016

(54) TRANSDUCER SUSPENSION ELEMENTS WITH BUILT-IN TINSEL WIRE

(71) Applicant: Bose Corporation, Framingham, MA (US)

(72) Inventors: Marek Kawka, Bolton, MA (US); Romain Kirszenblat, Allston, MA (US)

(73) Assignee: Bose Corporation, Framingham, MA (US)

( * ) Notice: Subject to any disclaimer, the term of this patent is extended or adjusted under 35 U.S.C. 154(b) by 106 days.

(21) Appl. No.: 14/267,373

(22) Filed: May 1, 2014

(65) Prior Publication Data

US 2015/0319531 A1 Nov. 5, 2015

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 1/06*** | (2006.01) |
| ***H04R 7/00*** | (2006.01) |
| *H04R 31/00* | (2006.01) |

(52) U.S. Cl.
CPC .. *H04R 1/06* (2013.01); *H04R 1/00* (2013.01); *H04R 7/00* (2013.01); *H04R 31/006* (2013.01)

(58) Field of Classification Search
CPC ..... H04R 9/043; H04R 1/06; H04R 31/006; H04R 7/16; H04R 7/20; H04R 2231/003; H04R 2307/204; H04R 2307/207
See application file for complete search history.

(56) References Cited

U.S. PATENT DOCUMENTS

| | | | | |
|---|---|---|---|---|
| 3,645,356 | A * | 2/1972 | Sotome | H04R 7/20 181/172 |
| 4,306,121 | A | 12/1981 | Joscelyn et al. | |
| 4,376,233 | A * | 3/1983 | Kamon | H04R 9/04 381/409 |
| 5,008,945 | A * | 4/1991 | Murayama | H04R 1/06 381/403 |
| 5,249,236 | A * | 9/1993 | Sakamoto | H04R 9/045 381/409 |
| 6,940,991 | B2 | 9/2005 | Shingu | |
| 8,295,538 | B2 | 10/2012 | Harris et al. | |
| 8,311,263 | B2 | 11/2012 | Huang | |

(Continued)

FOREIGN PATENT DOCUMENTS

| | | |
|---|---|---|
| GB | 1233206 | 5/1971 |
| JP | 3438015 B2 | 8/2003 |
| JP | 4123070 B2 | 7/2008 |

OTHER PUBLICATIONS

Questel, Conductive Damper for Speaker, JP11055792; JP3438015, Copyright 1999,JPO, 3 pages.

(Continued)

*Primary Examiner* — Matthew Eason

(57) ABSTRACT

A transducer suspension element is presented. The transducer suspension element includes a suspension member having a body, the body having a main portion, a first portion extending from the main portion and continuing to an outer edge, and a second portion extending from the main portion and continuing to an inner edge. At least one conductor is disposed within or on the suspension member body, the at least one conductor extending at least within a section of the first portion and within a section of the second portion of the suspension member, and wherein a length of the at least one conductor of the suspension member is greater than a minimal distance from the inner edge to the outer edge across the suspension member.

27 Claims, 4 Drawing Sheets

(56) References Cited

U.S. PATENT DOCUMENTS

2003/0202676 A1* 10/2003 Ohara ..... H04R 9/043 381/404
2004/0001603 A1* 1/2004 Sahyoun ..... H04R 1/06 381/404
2004/0008860 A1* 1/2004 Wu ..... H04R 1/06 381/404
2004/0104070 A1* 6/2004 Chan ..... H04R 9/043 181/166
2005/0254682 A1* 11/2005 Maekawa ..... H04R 9/043 381/404
2006/0159300 A1* 7/2006 Ohara ..... H04R 9/043 381/404
2006/0251285 A1* 11/2006 Chan ..... H04R 9/043 381/404
2007/0071274 A1* 3/2007 Andersen ..... H04R 1/06 381/404
2007/0189576 A1* 8/2007 Chan ..... H04R 9/043 381/404
2010/0046788 A1* 2/2010 Harris ..... H04R 9/043 381/404
2010/0092024 A1* 4/2010 Kaiya ..... H04R 1/06 381/409
2010/0172535 A1* 7/2010 Huang ..... H04R 7/20 381/404

OTHER PUBLICATIONS

Questel, Speaker and Manufacturing Method Thereof, JP2005020118; JP4123070 Copyright 2005JPO&NCIPI, 5 pages.

* cited by examiner

TRANSDUCER SUSPENSION ELEMENTS WITH BUILT-IN TINSEL WIRE

BACKGROUND

This disclosure relates to electro-acoustic transducers. Existing electro-acoustic transducer designs include a voice coil coupled to a diaphragm or other sound radiating element and at least one suspension element, such as a surround or spider. Conductors, such as tinsel wire, are used to couple an input signal to the voice coil. In existing designs, the transducer often requires additional space to accommodate the conductors due to movement of the conductors during transducer operation. Without the additional space, the conductors may come in contact with other components within the transducer, which can lead to distortion and other undesirable effects on the sound being output from the transducer. The movement of the conductors during transducer operation can also lead to mechanical fatigue on the conductors and result in the transducer being inoperable. To accommodate the additional space necessary for the conductors, the height of the transducer is increased, resulting in an increased overall package size that may be undesirable in transducers having a high excursion relative to the size of the transducer.

SUMMARY

All examples and features mentioned below can be combined in any technically possible way. Example mechanisms and techniques provide for electro-acoustic transducer suspension elements with built-in conductors that can be used in low-profile transducers. The proposed solution builds the conductors into one or more of the suspension members of the electro-acoustic transducer. The shape of the built-in conductor (once it enters the suspension member) can take various forms, including a "spring" (coiled) design or a "wave" design (which may look like a sinusoidal wave when viewed from the side). The non-linear shape of the built-in conductor may aid in preventing breakage of the conductor during operation of the electro-acoustic transducer due to strain and/or fatigue. By contrast, a substantially straight conductor frequently breaks near the edge of the suspension member during operation of the transducer. Providing a conductor having additional free length eliminates this failure point. In certain examples the suspension member includes tapered end portions projecting from the main portion of the suspension element. Thus, when viewed in cross section, the tapered end portions have a greater amount of thickness near the main portion, and reducing thickness when moving away from the main portion towards the inner and outer edges of the suspension element. The use of tapered end portions generates less fatigue on the conductor as it enters and/or exits the suspension member.

In one aspect, a suspension member of a transducer has a body, the body having a main portion, a first portion extending from the main portion and continuing to an outer edge, and a second portion extending from the main portion and continuing to an inner edge. The suspension member includes at least one conductor contained therein. The at least one conductor extends within the first portion, the main portion, and the second portion of the suspension member. A length of the at least one conductor within the suspension member body is greater than a minimal distance from the inner edge to the outer edge across the suspension member.

Examples may include one or more of the following features, or any combination thereof. A path of the at least one conductor within the suspension member may be substantially radial or at least partially traverse a circumference of the suspension member. The at least one conductor can comprise tinsel wire. The at least one conductor can have a wave shape within at least a portion of the suspension member or the at least one conductor can have a coiled shape within at least a portion of the suspension member. The suspension element may include at least one skin layer, the at least one skin layer surrounding a foam material, the at least one conductor being embedded within the foam material. At least one of the first portion and the second portion can have a generally tapered shape.

In another aspect, a suspension member of a transducer has a body, the body having a main portion, a first portion extending from the main portion and continuing to an outer edge, and a second portion extending from the main portion and continuing to an inner edge. The suspension member includes at least one conductor disposed along at least a portion of an outside surface of the suspension member. The at least one conductor has a first end and a second end. The first end extends within at least a section of the first portion and the second end extends within at least a section of the second portion. A length of the at least one conductor is greater than a minimal distance from the inner edge to the outer edge across the suspension member. At least one of the first portion and the second portion has a generally tapered shape.

Examples may include one or more of the following features, or any combination thereof. A path of the at least one conductor within the suspension member may be substantially radial or at least partially traverse a circumference of the suspension member. The at least one conductor can comprise tinsel wire. The at least one conductor can have a wave shape within at least a portion of the suspension member or the at least one conductor can have a coiled shape within at least a portion of the suspension member. The suspension element may include at least one skin layer, the at least one skin layer surrounding a foam material.

In another aspect, a suspension member of a transducer has a body, the body having a main portion, a first portion extending from the main portion and continuing to an outer edge, and a second portion extending from the main portion and continuing to an inner edge. The suspension member includes at least one conductor disposed within the suspension member body along an inside surface of the suspension member. The at least one conductor extends within the first portion, the main portion, and the second portion of the suspension member. A length of the at least one conductor within the suspension member body is greater than a minimal distance from the inner edge to the outer edge across the suspension member.

Examples may include one or more of the following features, or any combination thereof. A path of the at least one conductor within the suspension member may be substantially radial or at least partially traverse a circumference of the suspension member. The at least one conductor can comprise tinsel wire. The at least one conductor can have a wave shape within at least a portion of the suspension member or the at least one conductor can have a coiled shape within at least a portion of the suspension member. The suspension element may include at least one skin layer, the at least one skin layer surrounding a foam material, the at least one conductor being embedded within the foam material. At least one of the first portion and the second portion can have a generally tapered shape.

Note that each of the different features, techniques, configurations, etc. discussed in this disclosure can be executed independently or in combination.

BRIEF DESCRIPTION OF THE DRAWINGS

The above and further features and advantages may be better understood by referring to the following description in conjunction with the accompanying drawings, in which like reference characters refer to the same parts throughout the different views. The drawings are not necessarily to scale, emphasis instead being placed upon illustrating the principles of features and implementations.

DETAILED DESCRIPTION

Figure 1:
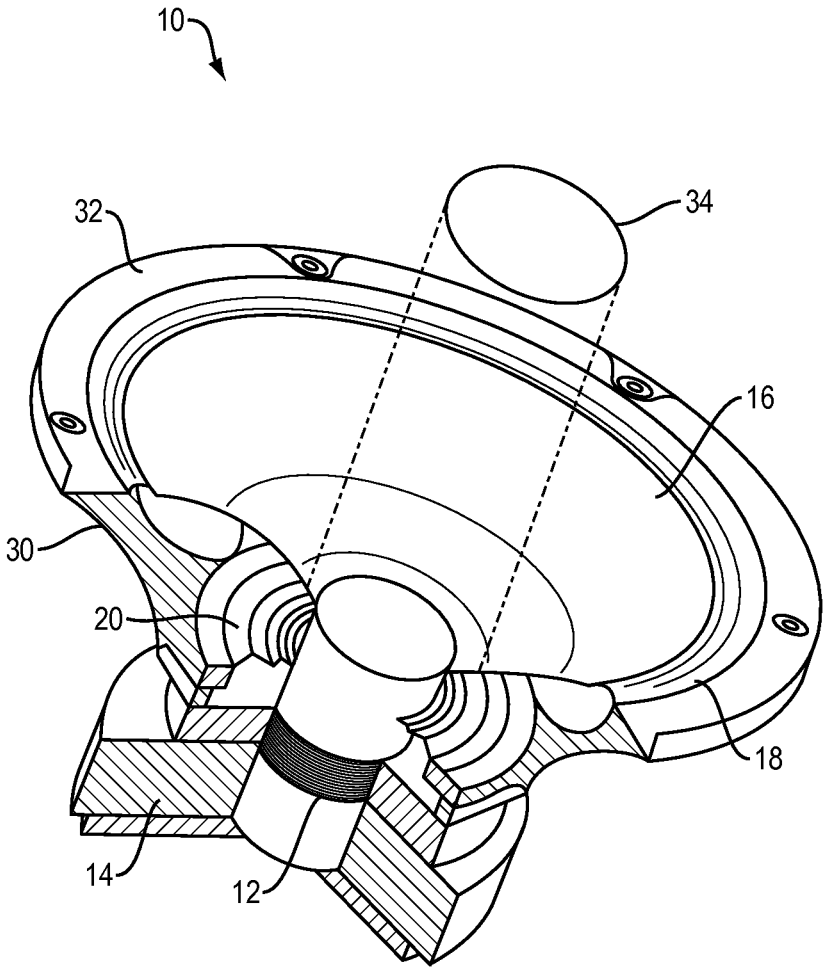
FIG. 1 depicts a cross-sectional view of an electro-acoustic transducer.

Referring to FIG. 1, a transducer 10 such as an electro-acoustic transducer (e.g., a loudspeaker) includes a voice coil 12, a permanent magnet 14, a diaphragm 16, and one or more suspension elements, sometimes referred to as a surround 18 and a spider 20. Also shown are a frame 32 for supporting the various parts of the transducer, and a dust cap 34 covering a top of a bobbin, on which the voice coil 12 is wound. Conductors (not shown in this view) are used to provide an input signal (current) to the voice coil 12. The voice coil 12 is positioned in a magnetic field provided by a permanent magnet 14. When the electrical current in the voice coil 12 changes direction, the magnetic forces between the voice coil 12 and the permanent magnet 14 also change, causing the voice coil 12 to move up and down, like a piston. This up-and-down movement of the voice coil 12 pushes and pulls on the diaphragm 16, which vibrates the air in front of the diaphragm 16, creating sound waves. The transducer 10 utilizes one or more suspension elements 18 and 20 to keep the voice coil 12 substantially centered while allowing movement of the voice coil 12 in a single plane.

The transducer includes a mechanism to provide power to the voice coil (which is moving within the transducer during operation of the transducer), and to do so without affecting the movement of the voice coil during operation. Typically, power is provided to the voice coil via one or more conductors, sometimes referred to as tinsel wires. The connection of the conductors to the voice coil must be flexible due the voice coil movement while also being failure resistant (for example, resistant to stress or fatigue). The conductors may be built into one or more of the suspension members of the electro-acoustic transducer. It is desirable to minimize or eliminate stress concentration points on the conductors to reduce the likelihood of breakage. One way to minimize or eliminate stress concentration points is to add additional free length to the conductors. Free length refers to the end-to-end length of a wire, in other words, the length of a wire between two end and/or attachment points.

If a conductor that is anchored at both ends is moved between two points, the conductor undergoes stress. During movement of the voice coil, the length (L) of the conductor is changed, due to strain on the conductor. By increasing the length of the built-in conductor, the amount of strain is reduced. The length of the conductor can be increased in various ways. For example, the conductor could take on a coiled shape or other shapes having a three-dimensional path. The conductor could also take on a wave shape (e.g., a sinusoidal wave, step function, triangular wave) or other shapes having a two-dimensional path. In general, the conductor could take on any non-linear shape that provides added length as compared to a linear arrangement of the conductor. With the added length, movement of the conductor between two points involves less strain on the conductor. The coiled shape, wave shape, or other non-linear shape can have any number of turns and any diameter for the turns. These and other parameters can be adjusted based on the application of the transducer, and may vary depending on the suspension size, desired excursion, etc.

In electro-acoustic transducers having built-in conductors that do not provide additional free length, the points where the conductor enters and/or exits the suspension member are typically the points of failure. The conductor is in electrical and mechanical communication with a voice coil. The voice coil, during operation of the transducer, moves in a vertical plane along with the conductor. This can result in fatigue of the conductor, especially at the points where the conductor enters and/or exits the suspension member. The fatigue can be from the conductor stretching and moving up and down during operation of the transducer. This fatigue can lead to mechanical failure of the conductor, rendering the transducer unusable. In general, any point where the conductor is constrained to change direction can lead to a failure as described herein.

Figure 2:
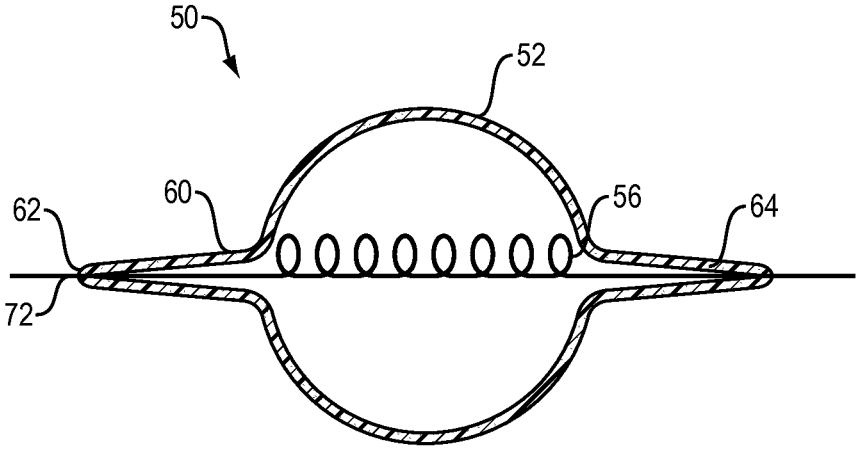
FIG. 2 depicts an example of an electro-acoustic transducer suspension member having a built-in coil-shaped conductor.

Referring now to FIG. 2, a cross-sectional view of an example suspension member 50 (which could be a surround or a spider) is shown. The suspension member 50 includes a body having a main portion 52. The main portion 52 may be generally circular, although other shapes could also be used. The main portion 52 may be, for example, a circular half roll having a single corrugation, a full roll, an inverted half roll (i.e., flipped over 180 degrees), or a roll having multiple corrugations. A corrugation as used herein comprises one cycle of a possibly repeating structure, where the structure typically comprises concatenated sections or arcs. The arcs are generally circular, but can have any curvature. The body also includes a first portion 60 extending from the main portion 52 and continuing to an outer edge 62. The body also includes a second portion 64 extending from the main portion 52 and continuing to an inner edge 66.

The suspension member 50 may be made from a flexible material, including, but not limited to, fabric, rubber, foam, or polyurethane (PU) plastic, such as thermoplastic polyurethane (TPU). The suspension member 50 may be made from multiple materials. For example, the suspension member 50 may comprise one or more skin layers that are filled with compressed or uncompressed foam, rubber or silicone. The skins could be made of various materials, including non-woven fabrics or woven fabrics, such as polyester. The skins could be porous or sealed with an elastomer, including but not limited to TPU. Alternatively, the suspension member 50 may comprise one or more skin layers surrounding a hollow area, unfilled with any material.

The suspension member 50 also includes at least one conductor 56 having a first end 70 and a second end 72. The first end 70 of the conductor 56 extends within the second portion 64 and continues to the inner edge 66 of the suspension member 50. The second end 72 of the conductor 56 extends within the first portion 60 and continues to the outer edge 62 of the suspension member 50. A length (L) of the conductor 56 within the suspension member 50 is greater than a minimal distance (D) from the inner edge 66 to the outer edge 62 across the suspension member 50. The shape of the conductor 56 in this example is coiled. In such a manner, the length of the conductor L is greater than the minimal measured distance D from end-to-end of the suspension member when viewed in cross-section, and this increased length makes the conductor 56 less susceptible to fatigue during use of the transducer.

As shown in the figures, the first and second portions 60, 64 have a tapered shape with the first and second portions including greater thickness near the main portion 52, and decreasing in thickness as the first and second portions extend away from the main portion 52 towards the inner and outer edges 66, 62. While a generally triangular tapered shape for the first and second portions are shown, it should be understood that the first and second portions could also comprise other shapes including but not limited to a circular projection, a rectangular projection and the like. By way of first portion 60 and second portion 64, there is less fatigue generated at the point where the conductor 56 enters and/or exits the suspension member 50. Due to the extended portions of the suspension member providing a certain amount of flexibility for the conductor during operation of the transducer, the stress experienced by the conductor as it enters and/or exits the extended portion is reduced. Providing a conductor having additional length through the coiled structure, as well as providing the extended portions of the suspension member serves to decrease the likelihood of breakage of the conductor near the edge of the suspension member.

Figure 3:
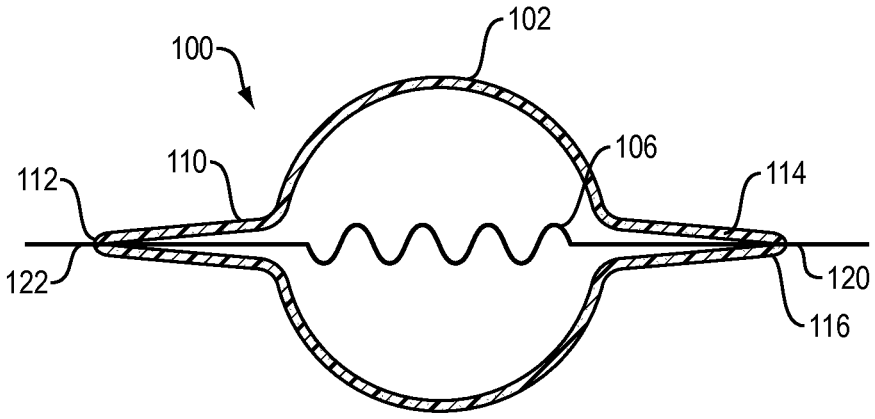
FIG. 3 depicts an example of an electro-acoustic transducer suspension member having a built-in wave-shaped conductor.

Referring now to FIG. 3, another example of a suspension member 100 having a built-in conductor is shown. The suspension member 100 includes a body having a main portion 102. The main portion 102 may be generally circular, although other shapes could also be used. As with the suspension member 50 shown in FIG. 2, the main portion 102 may be, for example, a circular half roll having a single corrugation, a full roll, an inverted half roll (i.e., flipped over 180 degrees), or a roll having multiple corrugations. The body includes a first portion 110 extending from the main portion 102 and continuing to an outer edge 112. The body also includes a second portion 114 extending from the main portion 102 and continuing to an inner edge 116. As with the suspension member 50 shown in FIG. 2, suspension member 100 may be made from one or more flexible materials, including but not limited to fabric, rubber, foam, PU, or TPU. Moreover, suspension member 100 may include one or more skin layers (that could be porous or sealed) filled with compressed or uncompressed foam, rubber or silicone. Alternatively, the suspension member 50 may comprise one or more skin layers surrounding a hollow area, unfilled with any material.

The suspension member 100 also includes at least one conductor 106 having a first end 120 and a second end 122. The first end 120 of the conductor 106 extends within the second portion 114 and continues to the inner edge 116 of the suspension member 100. The second end 122 of the conductor 106 extends within the first portion 110 and continues to the outer edge 112 of the suspension member 100. A length (L) of the conductor 106 within the suspension member 100 is greater than a minimal distance from the inner edge 116 to the outer edge 112 across the suspension member 100. The shape of the conductor in this example is a wave. In such a manner, the length of the conductor L is greater than the minimal measured distance D from end-to-end of the suspension member 100 when viewed in cross-section, and this increased length makes the conductor 106 less susceptible to fatigue during use of the transducer.

As shown in the figures, the first and second portions 110, 114 have a tapered shape with the first and second portions including greater thickness near the main portion 102, and decreasing in thickness as the first and second portions extend away from the main portion 102 towards the inner and outer edges 116, 112. While a generally triangular tapered shape for the first and second portions are shown, it should be understood that the first and second portions could also comprise other shapes including but not limited to a circular projection, a rectangular projection and the like. By way of first portion 110 and second portion 114 there is less fatigue generated at the point where the conductor 106 enters and/or exits the suspension member 100. Due to the extended portions of the suspension member providing a certain amount of flexibility for the conductor during operation of the transducer, the stress experienced by the conductor as it enters and/or exits the extended portion is reduced. Providing a conductor having additional length through the wave structure, as well as providing the extended portions of the suspension member serves to decrease the likelihood of breakage of the conductor near the edge of the suspension member.

Figure 4:
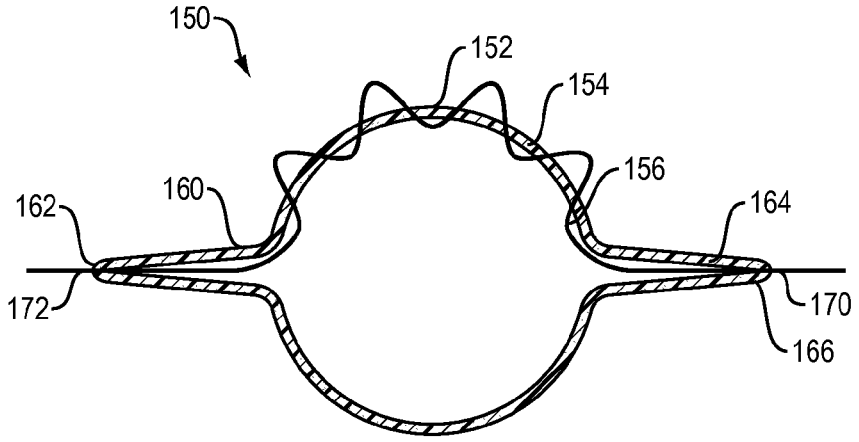
FIG. 4 depicts an example of an electro-acoustic transducer suspension member having a conductor disposed at least partially along an outer surface of the transducer suspension member.

Referring now to FIG. 4, another example of a suspension member 150 is shown. The suspension member 150 includes a body having a main portion 152. The main portion 152 may be generally circular, although other shapes could also be used. As with the suspension members of FIGS. 2 and 3, the main portion 152 may be, for example, a circular half roll having a single corrugation, a full roll, an inverted half roll (i.e., flipped over 180 degrees), or a roll having multiple corrugations. The body includes a first portion 160 extending from the main portion 152 and continuing to an outer edge 162. The body also includes a second portion 164 extending from the main portion 152 and continuing to an inner edge 166. As with the suspension members shown in FIGS. 2 and 3, suspension member 150 may be made from one or more flexible materials, including but not limited to fabric, rubber, foam, PU, or TPU. Moreover, suspension member 150 may include one or more skin layers (that could be porous or sealed) filled with compressed or uncompressed foam, rubber or silicone. Alternatively, the suspension member 150 may comprise one or more skin layers surrounding a hollow area, unfilled with any material.

The suspension member 150 also includes at least one conductor 156 having a first end 170 and a second end 172. The conductor 156 extends within at least a section of first portion 160, along at least a portion of an outside surface 154 of main body 152 and within at least a section of second portion 164. The first end 170 of the conductor 156 extends to the inner edge 166 of the suspension member 150. The second end 172 of the conductor 156 extends to the outer edge 162 of the suspension member 150. A length (L) of the conductor 156 along the suspension member 150 is greater than a minimal distance (D) from the inner edge 166 to the outer edge 162 across the suspension member 150. The conductor may have a coiled shape, or wave shape, or other non-linear shapes that provide added length as compared to a linear arrangement of the conductor. The length of the conductor 156 is greater than the minimal measured distance D from end-to-end of the suspension member 150, and this increased length makes the conductor 156 less susceptible to fatigue during use of the transducer.

As shown in the figures, the first and second portions 160, 164 have a tapered shape with the first and second portions including greater thickness near the main portion 152, and decreasing in thickness as the first and second portions extend away from the main portion 152 towards the inner and outer edges 166, 162. While a generally triangular tapered shape for the first and second portions are shown, it should be understood that the first and second portions could also comprise other shapes including but not limited to a circular projection, a rectangular projection and the like. By way of first portion 160 and second portion 164, there is less fatigue generated at the point where the conductor 156 enters and/or exits the suspension member 150. Due to the extended portions of the suspension member providing a certain amount of flexibility for the conductor during operation of the transducer, the stress experienced by the conductor as it enters and/or exits the extended portion is reduced. Providing a conductor having additional length, as well as providing the extended portions of the suspension member serves to decrease the likelihood of breakage of the conductor near the edge of the suspension member.

Figure 5:
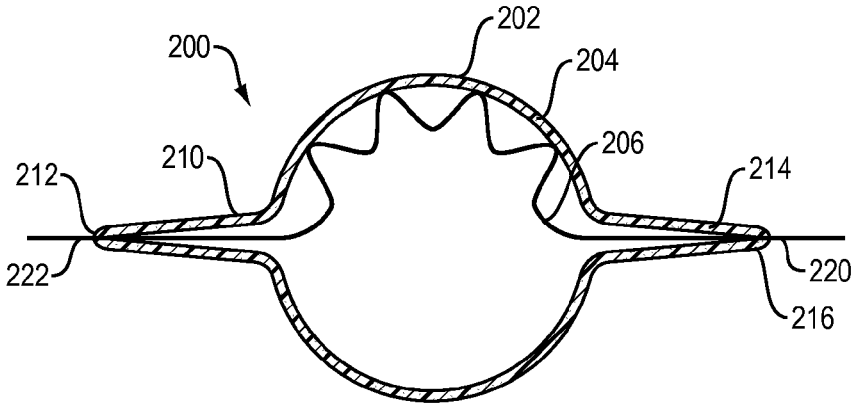
FIG. 5 depicts an example of an electro-acoustic transducer suspension member having a conductor disposed at least partially along an inner surface of the transducer suspension member.

Referring now to FIG. 5, another example of a suspension member 200 is shown. The suspension member 200 includes a body having a main portion 202. The main portion 202 may be generally circular, although other shapes could also be used. As with the suspension members of FIGS. 2, 3 and 4, the main portion 202 may be, for example, a circular half roll having a single corrugation, a full roll, an inverted half roll (i.e., flipped over 180 degrees), or a roll having multiple corrugations. The body includes a first portion 210 extending from the main portion 202 and continuing to an outer edge 212. The body also includes a second portion 214 extending from the main portion 202 and continuing to an inner edge 216.

The suspension member 200 also includes at least one conductor 206 having a first end 220 and a second end 222. The conductor 206 runs along at least a portion of an inside surface 204 of first portion 210, main body 202 and second portion 214. The first end 220 of the conductor 206 extends within the inner edge 216. The second end 222 of the conductor 206 extends within the outer edge 212 of the suspension member 200. The conductor may have a coiled shape, wave shape, or other non-linear shapes that provide added length as compared to a linear arrangement of the conductor. The length of the conductor L within the suspension member body 202 is greater than the minimal measured distance D from end-to-end of the suspension member 200, and this increased length makes the conductor 206 less susceptible to fatigue during use of the transducer.

As shown in the figures, the first and second portions 210, 214 have a tapered shape with the first and second portions including greater thickness near the main portion 202, and decreasing in thickness as the first and second portions extend away from the main portion 202 towards the inner and outer edges 216, 212. While a generally triangular tapered shape for the first and second portions are shown, it should be understood that the first and second portions could also comprise other shapes including but not limited to a circular projection, a rectangular projection and the like. By way of first portion 210 and second portion 214, there is less fatigue generated at the point where the conductor 206 enters and/or exits the suspension member 200. Due to the extended portions of the suspension member providing a certain amount of flexibility for the conductor during operation of the transducer, the stress experienced by the conductor as it enters and/or exits the extended portion is reduced. Providing a conductor having additional length, as well as providing the extended portions of the suspension member serves to decrease the likelihood of breakage of the conductor near the edge of the suspension member.

Figure 6:
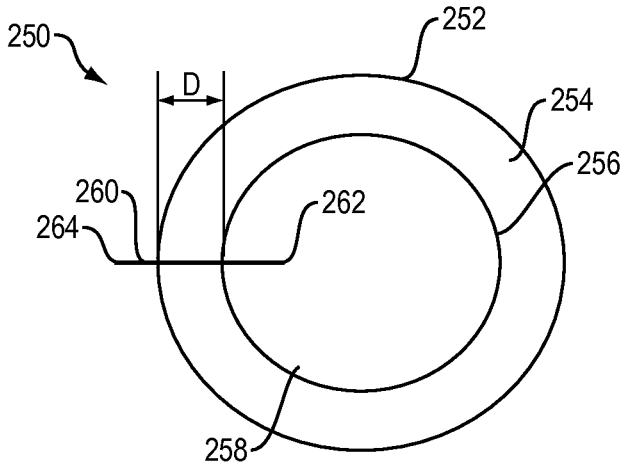
FIG. 6 depicts a cross-sectional top view of a first electro-acoustic transducer suspension member.

Referring now to FIG. 6, the path of the conductor through the suspension member can also vary. In this cross-sectional top view, suspension member 250 includes a body 254 having an outer edge 252 and an inner edge 256, the inner edge 256 defining a central opening 258 for attachment to a diaphragm or other sound radiating element. Conductor 260 runs through suspension element 250 and has a first end 262 extending through the inner edge 256 and, in some examples, into central opening 258. Conductor 260 also has a second end 264 extending through the outer edge 252. In the example shown in FIG. 6, conductor 260 has a radial shape, and enters and exits the suspension element 250 along a radius. Alternatively, conductor 260 could also enter and exit the suspension element at an angle relative to the inner edge 256 and outer edge 252, while taking a substantially straight path through the suspension element 250. The length of the conductor 260 within the suspension member body 254 is greater than the minimal measured distance D from the outer edge to the inner edge of the suspension member (for example, via a coiled shape, wave shape, or other non-linear shape that provides added length as compared to a linear arrangement of the conductor). This increased length makes the conductor 260 less susceptible to fatigue during use of the transducer.

Figure 7:
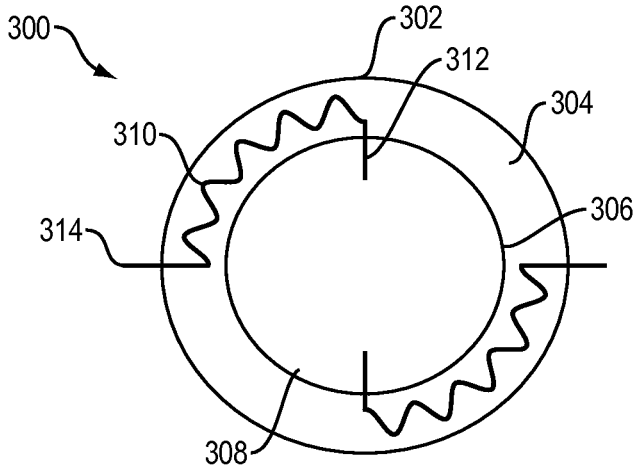
FIG. 7 depicts a cross-sectional top view of a second electro-acoustic transducer suspension member.

Referring now to FIG. 7, a cross-sectional top view of an electro-acoustic transducer suspension element 300 is shown. In this example, a path of the conductor 314 through the suspension member 300 at least partially traverses a circumference of the suspension member 300. Suspension member 300 includes a body 304 having an outer edge 302 and an inner edge 306, the inner edge 306 defining a central opening 308 for attachment to a diaphragm or other sound radiating element. Conductor 310 runs through suspension element 300 and has a first end 312 extending through the inner edge 306 and, in some examples, into central opening 308. Conductor 310 also has a second end 314 extending through the outer edge 302. The length of the conductor 310 within the suspension member body 304 is greater than the measured distance D from the outer edge to the inner edge of the suspension member (for example, via a coiled shape, wave shape, or other non-linear shape that provides added length as compared to a linear arrangement of the conductor). This increased length makes the conductor 310 less susceptible to fatigue during use of the transducer.

The one or more conductors could run through a plane within the suspension element or could follow the outer surface of the suspension element (on the top or bottom of a convolution). For example, in a suspension element comprising two skins filled with foam, the one or more conductors could be on top of the skin, under the skin, or encapsulated within the foam. The presently described electro-acoustic transducer suspension element is especially important for transducer designs having a high excursion relative to the size of the transducer, as it enables a design that has a shorter height with no additional space in between the suspension elements.

Throughout the entirety of the present disclosure, use of the articles "a" or "an" to modify a noun may be understood to be used for convenience and to include one, or more than one of the modified noun, unless otherwise specifically stated. Elements, components, modules, and/or parts thereof that are described and/or otherwise portrayed through the figures to communicate with, be coupled to, be associated with, and/or be based on, something else, may be understood to so communicate, be coupled to, be associated with, and or be based on in a direct and/or indirect manner, unless otherwise stipulated herein.

A number of implementations have been described. Nevertheless, it will be understood that additional modifications may be made without departing from the scope of the inventive concepts described herein, and, accordingly, other embodiments are within the scope of the following claims.

What is claimed is:

1. A transducer suspension element comprising:

a suspension member having a body, the body having a main portion, a first portion extending from the main portion and continuing to an outer edge, and the body having a second portion extending from the main portion and continuing to an inner edge; and at least one conductor within the suspension member body, the at least one conductor extending within the first portion, the main portion, and the second portion of the suspension member, and wherein a length of the at least one conductor within the suspension member body is greater than a minimal distance from the inner edge to the outer edge across the suspension member, wherein a path of the at least one conductor within the suspension member at least partially traverses a circumference of the suspension member.

2. The transducer suspension element of claim 1 wherein the at least one conductor comprises tinsel wire.

3. The transducer suspension element of claim 1 wherein the at least one conductor has a wave shape within at least a portion of the suspension member.

4. The transducer suspension element of claim 1 wherein the at least one conductor has a coiled shape within at least a portion of the suspension member.

5. The transducer suspension element of claim 1 wherein the suspension element further comprises at least one skin layer.

6. The transducer suspension element of claim 5 wherein the at least one skin layer surrounds a foam material, and the at least one conductor is embedded within the foam material.

7. The transducer suspension element of claim 1 wherein at least one of the first portion and the second portion have a generally tapered shape.

8. The transducer suspension element of claim 1 wherein the at least one conductor has one of: a two dimensional path and a three-dimensional path within at least a portion of the suspension member.

9. A transducer suspension element comprising:

a suspension member having a body, the body having a main portion, a first portion extending from the main portion and continuing to an outer edge, and the body having a second portion extending from the main portion and continuing to an inner edge; and at least one conductor disposed along at least a portion of an outside surface of the suspension member, the at least one conductor having a first end and a second end wherein the first end extends within at least a section of the first portion, wherein the second end extends within at least a section of the second portion, and wherein the at least one conductor extends along an outside surface of at least a portion of the main body, wherein a length of the at least one conductor is greater than a minimal distance from the inner edge to the outer edge across the suspension member, and wherein at least one of the first portion and the second portion have a generally tapered shape.

10. The transducer suspension element of claim 9 wherein a path of the at least one conductor within the suspension member is substantially radial.

11. The transducer suspension element of claim 9 wherein a path of the at least one conductor within the suspension member at least partially traverses a circumference of the suspension member.

12. The transducer suspension element of claim 9 wherein the at least one conductor comprises tinsel wire.

13. The transducer suspension element of claim 9 wherein the at least one conductor has a wave shape within at least a portion of the suspension member.

14. The transducer suspension element of claim 9 wherein the at least one conductor has a coiled shape within at least a portion of the suspension member.

15. The transducer suspension element of claim 9 wherein the suspension element further comprises at least one skin layer.

16. The transducer suspension element of claim 9 wherein the at least one skin layer surrounds a foam material.

17. The transducer suspension element of claim 9 wherein the at least one conductor has one of: a two dimensional path and a three-dimensional path within at least a portion of the suspension member.

18. A transducer suspension element comprising:

a suspension member having a body, the body having a main portion, a first portion extending from the main portion and continuing to an outer edge, and the body having a second portion extending from the main portion and continuing to an inner edge; and at least one conductor disposed within the suspension member body along an inside surface of the suspension member, the at least one conductor extending within the first portion, the main portion, and the second portion of the suspension member, and wherein a length of the at least one conductor within the suspension member body is greater than a minimal distance from the inner edge to the outer edge across the suspension member, wherein the first portion has a generally tapered shape.

19. The transducer suspension element of claim 18 wherein a path of the at least one conductor within the suspension member is substantially radial.

20. The transducer suspension element of claim 18 wherein a path of the at least one conductor within the suspension member at least partially traverses a circumference of the suspension member.

21. The transducer suspension element of claim 18 wherein the at least one conductor comprises tinsel wire.

22. The transducer suspension element of claim 18 wherein the at least one conductor has a wave shape within at least a portion of the suspension member.

23. The transducer suspension element of claim 18 wherein the at least one conductor has a coiled shape within at least a portion of the suspension member.

24. The transducer suspension element of claim 18 wherein the suspension element further comprises at least one skin layer.

25. The transducer suspension element of claim 18 wherein the at least one skin layer surrounds a foam material, and the at least one conductor is embedded within the foam material.

26. The transducer suspension element of claim 18 wherein the second portion has a generally tapered shape.

27. The transducer suspension element of claim 18 wherein the at least one conductor has one of: a two dimensional path and a three-dimensional path within at least a portion of the suspension member.

* * * * *